United States Patent [19]

Wefers et al.

[11] Patent Number: 4,818,302

[45] Date of Patent: Apr. 4, 1989

[54] METHOD OF HEAT TREATMENT

[75] Inventors: Karl Wefers, Upper Burrell Township, Armstrong County; Frank A. Mozelewski, Lower Burrell, both of Pa.

[73] Assignee: Aluminum Company of America, Pittsburgh, Pa.

[21] Appl. No.: 827,991

[22] Filed: Feb. 7, 1986

[51] Int. Cl.[4] ..... C21D 1/44

[52] U.S. Cl. ..... 148/13.1; 148/20.6

[58] Field of Search ..... 148/13.1, 13.2, 18, 148/20.3, 11.5 A, 11.5 M, 12.7 R, 12.7 A

[56] References Cited

U.S. PATENT DOCUMENTS

| | | | |
|---|---|---|---|
| 2,006,168 | 6/1935 | Hutchman | 148/20.6 |
| 2,900,272 | 8/1959 | Schneider | 148/13.1 |
| 3,459,602 | 8/1969 | Mueller | 148/20.6 |
| 3,671,335 | 6/1972 | Pavlik | 148/13.1 |
| 3,937,639 | 2/1976 | Romer et al. | 148/13.2 |

FOREIGN PATENT DOCUMENTS

| | | | |
|---|---|---|---|
| 58-48655 | 3/1983 | Japan | 148/13.1 |
| 60-100618 | 6/1985 | Japan | 148/13.2 |
| 791785 | 12/1980 | U.S.S.R. | 148/13.1 |

*Primary Examiner*—John P. Shaehan

*Attorney, Agent, or Firm*—Daniel A. Sullivan; Douglas P. Mueller

[57] ABSTRACT

A heat treating method comprising providing metal with a polymeric barrier coating, which acts as a barrier against diffusion of reactive species and which, upon thermal decomposition, acts as an oxygen getter or reducing agent, thus extending its protection past its point of thermal stability.

19 Claims, 2 Drawing Sheets

3,3,4,4,- BENZOPHENONETETRACARBOXYLIC ACID DIANHYDRIDE - OXYDIANILINE

---- OXIDE LAYER

500X

NOT COATED 525°C HIGH HUM.

COATED WITH BTDA- ODA 500X
525°C HIGH HUM.

METHOD OF HEAT TREATMENT

DESCRIPTION

1. Technical Field

This invention relates to the heat treatment of metals and more particularly to a technique for mitigating alteration of the chemical nature of the metal during heat treatment, especially in the case of aluminum alloyed with lithium.

2. Background Art

Lithium is the most reactive metal in the periodic system. Its diffusion rate in aluminum is very high, approaching $10^{-8}$ $cm^2$/sec at 550° C. As a result, Al Li alloys oxidize very rapidly during the thermal treatments required for ingot, plate, and sheet processing. Thick surface films form that consist of lithium oxide, lithium carbonate, lithium aluminum oxide, and even lithium hydride, if water was present. During rolling, these compounds can consume rolling lubricant by forming lithium soaps through reaction with the rolling lubricant. In the temperature range of commercial solution heat treatments (500° C.), the thickness of these films can be on the order of tens of microns. By comparison, oxide layers formed on magnesium alloys under comparable conditions do not exceed a thickness of 0.2–0.3 micron.

Severe oxidation leads to a depletion of lithium from the alloy. Thick oxide films increase tool wear in forming processes. Reactive lithium oxide on the metal surface accelerates degradation of lubricant due to the formation of lithium soaps according to the reaction:

$$Li_2O+2RCOOH \rightarrow 2RCOOLi+H_2O$$

In the presence of traces of moisture, which cannot easily be excluded from commercial atmospheres, the reaction $$2Li+H_2O \rightarrow Li_2O+2H$$

results in the solution of hydrogen in the base metal and eventually in hydrogen porosity.

GB 2 137 666 A discloses a method of heat treating aluminum-lithium alloys where a special atmosphere is used to reduce loss of lithium by oxidation. Protective atmospheres sufficiently free of oxidants are very difficult to maintain in large-scale industrial furnaces.

DISCLOSURE OF INVENTION

It is an object of the invention to provide a different approach to metal protection during heat treatment. This new approach can be used alone or it can be used as supplement to atmosphere control.

The driving force for the diffusion of lithium, for instance, to the surface is reaction $$Li^o \rightarrow Li^+ + e^-$$

which lowers the concentration of $Li^o$ at the metal/oxide interface, thus establishing the gradient for the diffusion of Li from the bulk to the surface. If we can find some means of stopping the creation of $Li^+$, this should offer the potential of accomplishing the desired protection of the metal during heat treatment.

A polymer coating on the metal during heat treatment was thought to offer such potential. It should act at the surface as a diffusion barrier and, at higher temperatures, as a reducing agent. It should thus provide a set of conditions having the potential of controlling, for instance, oxidation and hydrogen solution within acceptable limits. Such has been found to be the case. Thus, a principle of this invention is the applying of a polymeric barrier coating that, upon thermal decomposition, acts as an oxygen getter ($C+O_2 \rightarrow CO_2$), or reducing agent, in the interface region.

The invention is particularly applicable to the protection of lithium and its alloys, i.e. 0.1 to 100% lithium, and more particularly to aluminum lithium and magnesium lithium alloys, where the lithium content in the aluminum or magnesium can ragne from 0.1 to 15%.

The principles of the invention are also applicable to controlling oxidation with other aluminum alloys, especially high-magnesium alloys, i.e. 3 to 8% magnesium. The invention is in general useful for the protection of any precipitation hardening alloy, especially during solution heat treatment. In the case of precipitation hardenable aluminum alloys, solution heat treatment temperatures will range between 450° and 550° C.

Polymers suitable for use in the present invention include both thermoplastic and addition and condensation thermosetting polymers. Thermoplastic and addition thermosetting polymers would be thought perhaps to have an advantage over condensation thermosetting polymers in that they do not pose the danger of solution of hydrogen in the metal due to the water released during imidization. However, upon closer examination, hydrogen solution does not appear to result from this released water, it is believed for the reason that the water from the condensation reaction is driven off from the coatings before temperatures, for instance 350° C., are reached where hydrogen solution might occur by breakdown of the water. Thus, the Arrhenius behavior, i.e. exponential increase of reaction rate with temperature, works to the advantage of condensation thermosetting resins for this application.

High temperature durability and an ability to bond to the metal being covered are additional considerations in choosing suitable polymers.

The polymer may be applied to the metal to be protected dissolved in a solvent. Viscosity of the solution is important; if viscosity is too high, a coating is difficult to apply, while when too low, coating thickness may not be adequate, leading to flaking of the coating off of the metal. Besides solvent concentration, viscosity can also be affected by the molecular weight of the polymer.

Examples of suitable solvents are the organic solvents tetrahydrofuran (THF) and N,N-dimethylacetamide (DMAC). Depending on particular circumstances, suitable alternatives for THF may be dioxane, toluene, or chloroform; for DMAC alternatives may be DMSO, NMP (N-methyl pyrolidone), or DMF (dimethyl formamide).

Cross linking of thermosetting resins may be permitted to take place during heat treating.

The invention is particularly applicable to solution heat treatment of aluminum alloys, since this is in general the highest temperature heat treatment that aluminum alloys are subjected to. However, it is also applicable to any kind of heat treatment where conditions are such that material, or significant, alteration of the chemical nature of the metal would occur by surface attack, but for some type of protection. What is material depends on the particular metal being dealt with. In the case of aluminum lithium alloy, an increase of 1 micron in the thickness of the oxide layer on the alloy is an example of a material alteration. For the same alloy, an increase of 0.1 ppm in hydrogen content is another example of a material alteration.

The invention is applicable in general to processes involving the heating of metal to 200° C. and above, and particularly 350° C. and above, where reaction rates are such that metal is susceptible to damage by surface contamination and reaction, e.g. hydrogen solution and oxidation, respectively. Thus, the invention can be used to advantage in the case of metal being heated prior to forging, in order to reduce metal compositional changes during such heating.

Percentages herein are on a weight basis, unless stated otherwise.

Low humidity test conditions were created using air which at room temperature had 5 ppm, i.e. 0.004 mm Hg, water vapor, while high humidity conditions were with air of 17.5 mm Hg water vapor at room temperature, i.e. air saturated with water at room temperature.

BEST MODE FOR CARRYING OUT THE INVENTION

Polyimides are a preferred polymer for fulfilling the goals of the invention. These polymers are thermally stable to temperatures above 400° C. and bond strongly to aluminum surfaces. Their structure is based on an aromatic-ring backbone with a high C-to-H ratio which forms a carbon residue (most likely graphitic) upon thermal decomposition.

Figure 1:
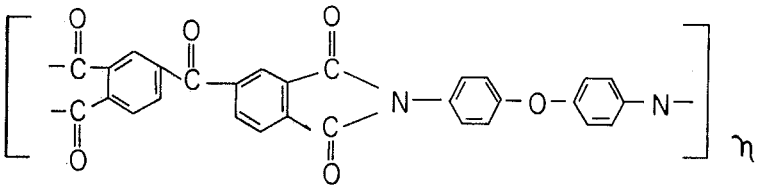
FIG. 1 is the structural formula of a polymer suitable for use in the present invention.

BTDA-ODA, poly(3,3,4,4,-benzophenonetetracarboxylic acid dianhydride-oxydianiline), whose structure is as shown in FIG. 1, is a polyimide which was selected after preliminary testing because it can easily be applied by brush painting or other methods such as spraying or dipping, after dilution with DMAC (20% polyimide, 80% solvent), as a solution of syrupy consistency to form a uniform, protective coating.

The BTDA-ODA used was prepared as follows: 3,3',4,4'-benzophenone tetracarboxylic acid dianhydride (BTDA) was obtained from a commercial source and purified by sublimation at 215° C. at less than 1 torr to obtain BTDA of melting point 558° K. Oxydianiline (ODA) was obtained from a commercial source and purified by recrystallization; see Bell et al., *J. Polym. Sci. Polym. Chem. Ed.*, Vol. 14, p. 2275 (1976). Polymerization was carried out in solution containing 20% solids by adding a given number of mols of the diamine ODA, and DMAC as the solvent, to a flask flushed with dry nitrogen. Then a number of mols of dianhydride BTDA equal to the number of mols of ODA was added as a solid in a single portion and the solution stirred at room temperature under $N_2$. The result of this procedure is the formation of a solution of the polyamic acid in DMAC. The structural formula of the particular polyamic acid appears in the middle of page 620 in *POLYIMIDES*, Vol. 2, Edited by K. L. Mittal, Plenum Publishing Corp., 1984. Coating was done by painting the metal test specimens with this solution of polyamic acid, as polyimide precursor.

The solvent was driven off by warming the coated workpiece at 65° C. for about 1 hour. Imidization takes place between 200°-300° C. while the coated metal is heated to the final soak temperature. Heating rates of 20°-30° C./min were found to be slow enough for curing. Curing changes the polyamic acid into the BTDA-ODA structure as shown in FIG. 1. The clear polymer coatings decompose to a black, carbonaceous film at temperatures above 400° C.; this carbon layer provides a reducing condition at the metal surface.

Figure 2:
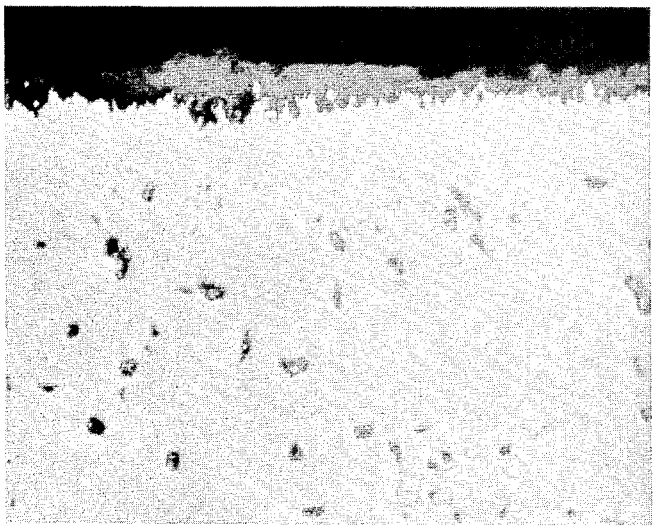
FIG. 2 is a photomicrographic, cross sectional view of an aluminum alloy sample heated without a protecting coating according to the invention.

Repeated tests with aluminum alloy 2090 (percentage composition 2.7Cu, 2.2Li, 0.12Zr, balance essentially aluminum) confirmed that the oxidation rate even in humid air at 550° C., the most severe condition for oxide formation and hydrogen solution, remained lower by a factor of 3 compared to that of an unprotected sample. This is evident from comparison of the photomicrographs of FIGS. 2 and 3. Hydrogen concentration and porosity were also significantly diminished as evidenced by the hydrogen analyses presented in Table I and comparison of the micrographs of FIGS. 2 and 3, the unprotected sample in FIG. 2 showing a large number of voids as compared to the protected sample in FIG. 3. The diminished hydrogen concentrations and porosity achieved by use of BTDA-ODA coatings is particularly surprising in view of the fact that the imidization reaction in this coating does involve the release of water.

A very advantageous characteristic of the black, carbonaceous film left following this heat treatment is that it lifts cleanly from the aluminum surface, upon application of water either alone or in mixture other chemicals.

Figure 3:
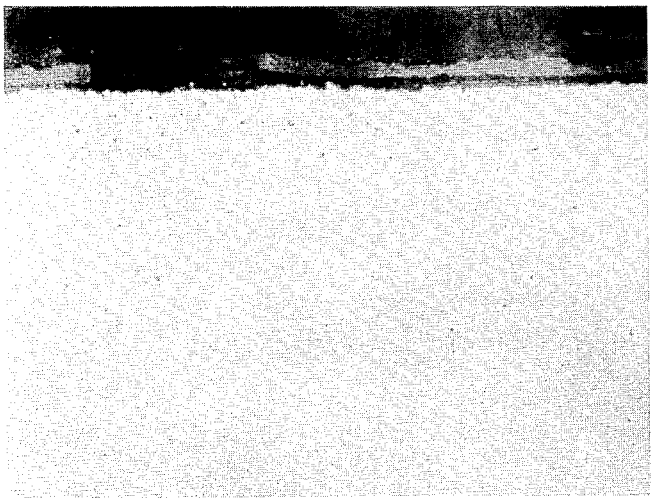
FIG. 3 is a view as in FIG. 2 of the same aluminum alloy first provided with a protective coating according to the invention and then subjected to the same heat treatment as in FIG. 2.

To further illustrate the invention, specimens of Al-2Li-3Cu were first weighed and then half their number were coated with BTDA-ODA polyimide precursor as above. The coatings were applied by brush coating. It was found that thicker coatings give better protection. For purposes of these experiments a coating thickness as shown in FIG. 3 was used. This can be achieved by a single liberal coating or two thin coatings, both procedures giving essentially the same results as a function of total coating thickness. The coatings were dried between applications; drying was for one hour at 65° C. It was found that a separate drying step could be eliminated by putting the specimens in an oven at room temperature and bringing the temperature to the 475° or 550° C. test temperature at a constant rate over 30 minutes.

TABLE I

| | HYDROGEN CONTENT (ppm) | |
|---|---|---|
| | 400° C. Low Humidity | 500° C. High Humidity |
| Not Coated | 0.32 | 0.34 |
| BTDA-ODA | 0.11 | 0.12 |

This combines the drying with the imidization. The coated and uncoated specimens were exposed to dry or moist air at 475° and 500° C. for 4 hours and then stripped of all polymer and oxidation product, in order to determine metal weight loss expressed as grams per square meter. Results are shown in Table II. The protection provided is shown by the lower weight losses for the specimens which had been coated.

Stripping was done using a solution of 20 g of chromic acid ($CrO_3$) and 35 ml of 85% phosphoric acid ($H_3PO_4$) in 1000 ml of water. The solution contains 0.20M $CrO_3$ and 0.65M $H_3PO_4$. The solution was found to operate successfully at any temperature in the range between 100° and 180° C., and up to boiling (see ASTM B 137–45). The samples were immersed in heated solution for 5 minute increments, until a constant weight was obtained. Between immersions, the samples were rinsed in de-ionized water and air dried.

TABLE II

Al—Li (2090) OXIDATION - COATING PROTECTION
Metal Weight Loss ($GM/M^2$)

| | Not Coated | Coated with BTDA-ODA |
|---|---|---|
| 475° C./4 Hr. | | |
| High Humidity Air | 12.0 | 3.0 |
| Low Humidity Air | 4.0 | 2.0 |
| 550° C./4 Hr. | | |
| High Humidity Air | 15.0 | 6.0 |
| Low Humidity Air | 6.0 | 4.0 |

We claim:

1. In a method of treating an aluminum or magnesium alloy under conditions such that material alteration of the chemical nature of the alloy would occur by surface attack, the improvement comprising heat treating the alloy with a polymer coating on it for mitigating said alteration, the polymer coating being thermally stable to temperatures above 400° C., the polymer coating being effective for said mitigating even at solution heat treatment temperatures.

2. A method as claimed in claim 1, said alloy comprising at least 0.1 lithium.

3. A method as claimed in claim 1, said alloy being an aluminum alloy containing 0.1 to 15% lithium.

4. A method as claimed in claim 1, said alloy being a magnesium alloy containing 0.1 to 15% lithium.

5. A method as claimed in claim 1, said alloy being an aluminum alloy containing 3 to 8% magnesium.

6. A method as claimed in claim 1, the polymer coating comprising poly(3,3,4,4,-benzophenonetetracarboxylic acid dianhydride-oxydianiline).

7. A method according to claim 1, whrein the polymer is selected from the group consisting of thermoplastic polymers, addition thermosetting polymers and condensation thermosetting polymers.

8. A heat treating method comprising providing an aluminum or magnesium alloy with a polymeric barrier coating that, upon thermal decomposition, acts as an oxygen getter or reducing agent, and heating the alloy under conditions sufficient to cause said thermal decomposition, the polymer coating being thermally stable to temperatures above 400° C.

9. A method as claimed in claim 8, said polymer comprising poly(3,3,4,4,-benzophenonetetracarboxylic acid dianhydride-oxydianiline), said alloy being aluminum alloy 2090, the step of heating being to about 500° C. or above.

10. A method of heat treating a precipitation hardening aluminum or magnesium alloy comprising coating the metal with polymer and then solution heat treating the metal, the polymer coating being thermally stable to temperatures above 400° C., the polymer coating being thermally stable even at solution heat treatment temperatures.

11. A method as claimed in claim 10, wherein the alloy is an aluminum alloy.

12. A method as claimed in claim 11, wherein the aluminum contains 0.1 to 15% lithium.

13. A method as claimed in claim 12, the coating comprises applying to the alloy a solution of polyamic acid.

14. A method as claimed in claim 13, the polyamic acid evolving water as a reaction product upon heating, further comprising driving the water reaction product from the coating at temperatures below 350° C.

15. A method according to claim 10, wherein the polymer is selected from the group consisting of thermoplastic polymers, addition thermosetting polymers and condensation thermosetting polymers.

16. A method of heat treating a precipitation hardening aluminum or magnesium alloy comprising coating the metal with polymer and then solution heat treating the metal, the polymer coating being thermally stable to temperatures above 400° C., the step of solution heat treating decomposing the polymer coating into a carbonaceous film on the alloy, further comprising washing the carbonaceous film from the alloy with water subsequent to the step of solution heat treating.

17. A method comprising heat treating an aluminum or magesium alloy with a polymer coating on it at a temperature of at least 200° C., the polymer coating being thermally stale to temperatures above 400° C., the polymer coating being thermally stable even at solution heat treatment temperatures.

18. A method as claimed in claim 17, the temperature rising to at least 350° C. in the heat treatment.

19. A method according to claim 17, wherein the polymer is selected from the group consisting of thermoplastic polymers, addition thermosetting polymers and condensation thermosetting polymers.

* * * * *

UNITED STATES PATENT AND TRADEMARK OFFICE

CERTIFICATE OF CORRECTION

PATENT NO. : 4,818,302

DATED : April 4, 1989

INVENTOR(S) : Karl Wefers et al

It is certified that error appears in the above-identified patent and that said Letters Patent is hereby corrected as shown below:

| | |
|---|---|
| Col. 2, line 12 | Change "ragne" to --range--. |
| Claim 2, Col. 5, line 33 | After "0.1" insert --%--. |
| Claim 12 Col. 6, line 18 | After "aluminum" insert --alloy--. |
| Claim 17 Col. 6, line 40 | Change "magesium" to --magnesium--. |

Signed and Sealed this

Seventh Day of November, 1989

*Attest:*

JEFFREY M. SAMUELS

*Attesting Officer* *Acting Commissioner of Patents and Trademarks*